US010018201B2

(12) United States Patent
Jia et al.

(10) Patent No.: US 10,018,201 B2
(45) Date of Patent: Jul. 10, 2018

(54) FAN AND MOULD FOR MAKING THE SAME

(71) Applicants: BEIJING LENOVO SOFTWARE LTD., Beijing (CN); LENOVO (BEIJING) LIMITED, Beijing (CN)

(72) Inventors: Zizhou Jia, Beijing (CN); Zhigang Na, Beijing (CN); Ying Sun, Beijing (CN)

(73) Assignees: BEIJING LENOVO SOFTWARE LTD., Beijing (CN); LENOVO (BEIJING) LIMITED, Beijing (CN)

( * ) Notice: Subject to any disclaimer, the term of this patent is extended or adjusted under 35 U.S.C. 154(b) by 370 days.

(21) Appl. No.: 14/657,868

(22) Filed: Mar. 13, 2015

(65) Prior Publication Data

US 2016/0053771 A1 Feb. 25, 2016

(30) Foreign Application Priority Data

Aug. 22, 2014 (CN) ..... 2014 1 0419654
Sep. 1, 2014 (CN) ..... 2014 2 0499850 U
Dec. 3, 2014 (CN) ..... 2014 1 0728095

(51) Int. Cl.

*F04D 29/38* (2006.01)
*F04D 25/06* (2006.01)
*F04D 29/02* (2006.01)
*F04D 29/28* (2006.01)

(52) U.S. Cl.

CPC ..... *F04D 25/0613* (2013.01); *F04D 29/023* (2013.01); *F04D 29/281* (2013.01); *F05D 2230/21* (2013.01); *F05D 2300/43* (2013.01); *F05D 2300/436* (2013.01); *F05D 2300/603* (2013.01)

(58) Field of Classification Search

CPC ..... F04D 29/281
See application file for complete search history.

(56) References Cited

U.S. PATENT DOCUMENTS 7,364,411 B2 * 4/2008 Tamagawa ..... F01D 1/02 416/187
2004/0013526 A1 * 1/2004 Nilson ..... F04D 29/326 416/189

FOREIGN PATENT DOCUMENTS

CN 201399857 Y 2/2010
CN 202140342 U 2/2012
CN 102954035 A 3/2013
(Continued)

OTHER PUBLICATIONS

Abstract of CN102954035A, Mar. 6, 2013, p. 1.
(Continued)

*Primary Examiner* — Logan Kraft
*Assistant Examiner* — Jason Fountain

(57) ABSTRACT

Embodiments of the application disclose a fan and a mold for making a fan blade structure for the fan. An embodiment of the fan comprises a fan blade structure and the fan blade structure comprises a mounting ring and a plurality of fan blades provided on the mounting ring, wherein mounting ring and the fan blades are integrally formed. The mold comprises a mounting ring and a plurality of fan blades provided on the mounting ring, the mold comprising a cavity having a ring-shaped channel configured for forming the mounting ring and a plurality of fan blade channels configured for forming the plurality of fan blades, in order to integrally form the fan blade structure.

18 Claims, 8 Drawing Sheets

(56) References Cited

FOREIGN PATENT DOCUMENTS

| | | | |
|---|---|---|---|
| CN | 103317139 | A | 9/2013 |
| CN | 203430848 | U | 2/2014 |
| CN | 104165149 | A | 11/2014 |
| CN | 204126918 | U | 1/2015 |
| CN | 204299902 | U | 4/2015 |
| JP | 10-37894 | A | 2/1998 |
| JP | 10-325397 | A | 12/1998 |
| JP | 2009-156187 | A | 7/2009 |
| JP | 5012210 | B2 | 8/2012 |
| JP | 5141808 | B1 | 2/2013 |

OTHER PUBLICATIONS

Abstract of CN203430848U, Feb. 2, 2014, p. 1.
Abstract of CN204126918U, Jan. 1, 2015, p. 1.
Abstract of JP10-37894A, Feb. 13, 1998, p. 1.
Abstract of JP10-325397A, Dec. 8, 1998, p. 1.
Abstract of JP2009-156187A, Jul. 16, 2009, p. 1.
Abstract of JP5141808B1, Feb. 13, 2013, p. 1.
First Office Action dated Jul. 7, 2017 for the Chinese corresponding patent application No. 201410728095.9 (7 pgs.).
Eng. Abstract of CN 103317139 (1 pg.).
Eng. Abstract of CN 104165149 (1 pg.).
Eng. Abstract of CN 202140342 (1 pg.).
Eng. Abstract of CN 204299902 (1 pg.).
Second Office Action dated Dec. 7, 2017 for Chinese patent application No. 201410728095.9. (8 pg.).
English Abstract of CN 201399857 (1 pg.).
English Abstract of JP 5012210 (1 pg.).

* cited by examiner

FAN AND MOULD FOR MAKING THE SAME

CROSS-REFERENCE TO RELATED APPLICATION

This application claims the benefits of Chinese Patent Application No. 201410419654.8 filed on Aug. 22, 2014, 201420499850.6 filed on Sep. 1, 2014, and 201410728095.9 filed on Dec. 3, 2014 in the State Intellectual Property Office of China, whole disclosures of which are incorporated herein by reference.

BACKGROUND OF THE INVENTION

Field of the Invention

The present application relates to the field of electromechanical technology, and specifically to a fan, a mould for making a fan blade structure, and an electronic device comprising a fan.

Description of the Related Art

With the development of technologies, electronic technology has been rapidly developed, kinds of electronic products have appeared, and people are enjoying the convenience brought by technologies. Currently, people can enjoy comfort lives brought by the development of technologies through kinds of electronic products. Take the computer, such as a desktop PC, a notebook PC, an integrated computer and the like, as an example, it has become one of indispensable electronic products for people's work and lives for its high speed calculation and large storage volume.

Heat will be generated during operation of a computer, and in order to avoid a harmful influence to the components inside the computer caused by a high temperature, a fan will provided inside the computer so as to facilitate heat dissipation from inside to outside of the computer.

A weight decrease of a fan usually will cause a strength decrease, and in turn the performance of the fan is also decreased.

Therefore, there exists a technical problem of decreasing a weight of a fan while promoting a performance of the fan.

SUMMARY OF THE INVENTION

According to one aspect of the application, there is provided a fan, comprising a fan blade structure, which comprises a mounting ring and a plurality of fan blades provided on the mounting ring. The mounting ring and the fan blades are integrally formed.

According to a further aspect of the application, there is provided a mould configured for making a fan blade structure comprising a mounting ring and a plurality of fan blades provided on the mounting ring. The mould comprises a cavity to integrally form the fan blade structure, and the cavity comprises a ring-shaped channel configured for forming the mounting ring, and a plurality of fan blade channels configured for forming the plurality of fan blades.

The above description is intended to provide a summary of technical solutions, so that those skilled in the art can more clearly understand the concept of the application and implement the application with reference to the description. Detailed and preferable embodiments of the application will be described hereinafter with reference to the attached drawings.

BRIEF DESCRIPTION OF THE DRAWINGS

The above and other features of the embodiments will become more apparent by describing in detail exemplary embodiments thereof with reference to the accompanying drawings, in which.

DETAILED DESCRIPTION OF PREFERRED EMBODIMENTS OF THE INVENTION

Figure 1:
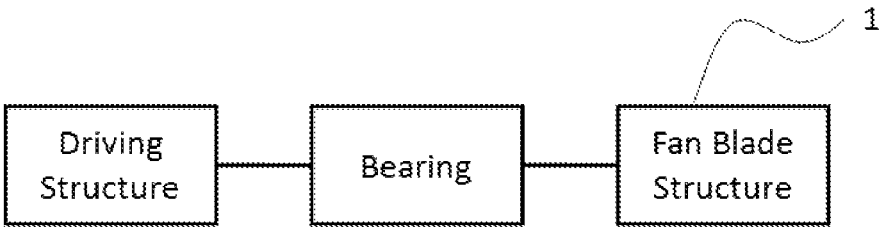
FIG. 1 is a schematic view showing an operating principle of a fan according to an embodiment of the present application.

Exemplary embodiments of the present disclosure will be described hereinafter in detail with reference to the attached drawings, wherein the like reference numerals refer to the like elements. The present disclosure can, however, be embodied in many different forms and should not be construed as being limited to the embodiment set forth herein; rather, these embodiments are provided so that the present disclosure will be thorough and complete, and will fully convey the concept of the disclosure to those skilled in the art.

Term "and/or" used herein indicates a parallel relationship between associated objects, and it indicates three different relationship, for example, "A and/or B" indicates: only A exists, both A and B exist, and only B exists.

The present disclosure provides a fan and an electronic device, which can decrease weight of the fan and improve performance of the fan. Detailed descriptions of embodiments of the disclosure are provided as follows with reference to the attached drawings.

Operating Principles of a Fan

As shown in FIG. 1, a fan according to an embodiment of the application comprises a driving structure.

Specifically, in the fan according to an embodiment of the application, the driving structure provides a rotational power to the fan. A force generated by a magnetic field inside the driving structure to a winding will cause a substantial influence to the rotation speed of a blade structure 1. The greater the force is, the higher the rotation speed of the fan becomes, and vise verse. Therefore, a control to rotation speed of the fan can be realized through controlling the driving structure.

Specifically, the driving structure comprises a DC motor, a DC brushless motor, and the like. After a DC current or an AC current inside the electronic device is passed through a transformer or a rectifier circuit, it is inputted into the driving structure under the control of a control circuit, so that the driving structure drives the blade structure 1 to rotate, and thereby wind is generated by the blade structure 1. Of course, those skilled in the art can choose any suitable driving structure and specific circuit according to practical requirements, which is not defined herein. The blade structure 1 is connected to the driving structure. The driving structure drives the blade structure 1 to rotate, such that wind is generated by the blade structure 1 so as to facilitate heat dissipation of the electronic device.

Figure 2A:
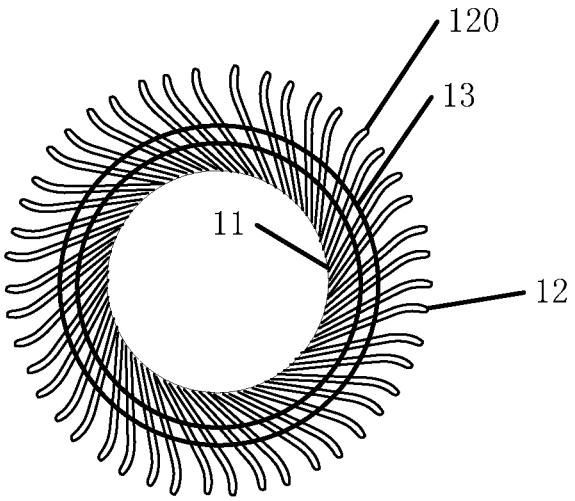
FIGS. 2*a* and 2*b* are schematic views showing blade structures according to embodiments of the present application.
Figure 2B:
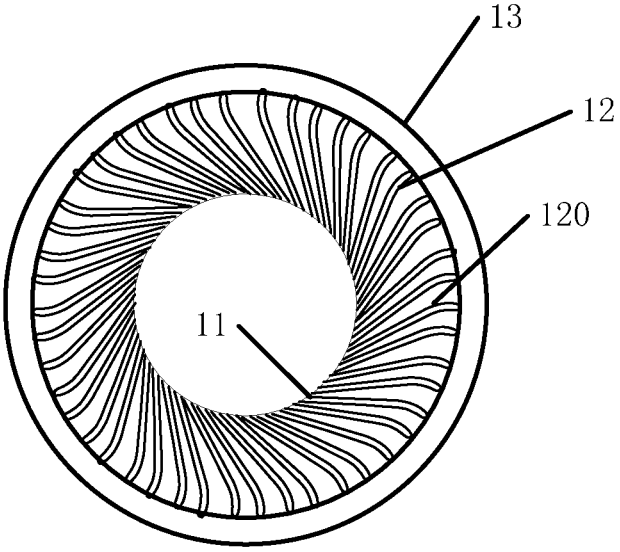

As shown in FIGS. 2*a* and 2*b*, the blade structure 1 comprises a mounting ring 11, which can be driven by the driving structure and in turn the blade structure 1 is driven to rotate.

The following specification on how the mounting ring 11 is driven to rotate by the driving structure is based on a DC brushless motor. A stator of the driving structure, i.e., a winding, is secured in an electronic device. One end of a bearing is rotatably connected to the stator. The other end of the bearing is secured to the mounting ring 11 to secure and support the mounting ring 11. There is a magnet provided inside the mounting ring 11 to form a magnetic field. When the DC brushless motor is connected to a power source, a current is generated in the closed circuit of the winding while a magnetic field exists inside the mounting ring 11, thus the mounting ring 11 will be rotated according to a common sense of physics. And an axis of the rotation is an axis of the bearing. Therefore, the mounting ring 11 and the bearing act as a stator of the DC brushless motor.

In the embodiment of the present application, the bearing is made from iron, aluminum, or other metals. Also, the bearing can be made from a stainless steel or ceramics. Of course, in order to further decrease the weight of the fan, the bearing can also be made from other light weight non-metal material, such as plastics.

In one embodiment, the bearing is cylinder-shaped having a constant radius or the bearing consists of different cylinders having different radiuses. For example, each of two ends of the bearing is cylinder-shaped having a radius of 0.25 cm, an intermediate part of the bearing is cylinder-shaped having a radius of 0.27 cm, and the length of the cylinder having a radius of 0.25 cm is 0.3 cm, and the length of the intermediate cylinder is 0.5 cm. Values of these sizes could be chosen by those skilled in the art according to practical requirements, which is not defined herein.

Further, in the embodiment of the application, the fan blade structure comprises N (i.e., a plurality of) fan blades 12. The fan blades 12 are disposed on the mounting ring 11, wherein the fan blades 12 are integrated to the mounting ring 11, in other words, the fan blades 12 and the mounting ring 11 are made through a single mould to form an integral fan blade structure.

According to a first aspect of the application, there is provided a fan having a novel structure.

General Concept of the Fan

In order to solve the technical problem mentioned in the background part of the specification, a general concept of the fan according to the application is as follows.

A fan comprises:

a fan blade structure comprising a mounting ring and a plurality of fan blades provided on the mounting ring, wherein the mounting ring and the fan blades are integrally formed.

First Embodiment of the Fan

A fan according to a first embodiment of the application is as follows.

A fan comprises:

a driving structure; and a fan blade structure connected to the driving structure;

wherein the fan blade structure comprises:

a mounting ring connected to the driving structure, the driving structure being able to drive the mounting ring to rotate and in turn being able to drive the fan blade structure to rotate; and N fan blades provided on the mounting ring, a thickness of each fan blade is smaller than 0.35 mm, N being an integer and $35<N\leq70$.

In the technical solution of the present application, the fan blade structure comprises: a mounting ring connected to the driving structure, the driving structure being able to drive the fan blade structure to rotate; and N fan blades provided on the mounting ring, and a thickness of each fan blade is smaller than 0.35 mm, wherein N is an integer and $35<N\leq70$. With such a configuration, the fan blades according to the embodiment of the application is made much thinner than before, so that the weight of the fan can be decreased, and the number of the fan blades is much larger, and stronger heat dissipation ability can be provided for the electronic device.

In order to decrease the weight of the fan, in the embodiment of the application, the thickness of each fan blade 120 of the N fan blades is set to be smaller than 0.35 mm. Therefore, each fan blade in the present application is much thinner than before, and in the event of having the same number of fan blades, the weight of the fan according the embodiment of the application is much lighter than before. Since the fan blades 12 are thinner, the number of the N fan blades is set to be more than 35 and no more than 70 so as to improve performance of the fan, wherein N is an integer.

When the number of fan blades increases, the fan blade structure 1 promotes performance of air flow, and thereby heat dissipation performance is promoted.

Further, the thickness of each fan blade 120 of the N fan blades is set to be smaller than 0.35 mm in the present application, however, in practical situations, it is a good choice to set the thickness to be larger than 0.1 mm and no larger than 0.25 mm.

Further, the thickness of each fan blade 120 of the N fan blades is set to be smaller than 0.35 mm, thus the fan blades are easily damaged during a demoulding process. In order to avoid such damage, in the embodiment of the application, the fan blade structure 1 further comprises a demoulding ring 13.

The demoulding ring 13 is provided on the N fan blades 12, as shown in FIGS. 2*a* and 2*b*. A first radius of the demoulding ring 13 is larger than a second radius of the mounting ring 11. For example, the first radius of the demoulding ring 13 is 3.9 cm, the second radius of the mounting ring 11 is 1.7 cm; or, the first radius of the demoulding ring 13 is 4 cm, the second radius of the mounting ring 11 is 1.7 cm; or, the first radius of the demoulding ring 13 is 3.9 cm, the second radius of the mounting ring 11 is 2 cm. Specific values of the radiuses could be chosen by those skilled in the art according to practical requirements, and will not be defined herein.

With the demoulding ring 13 provided on the N fan blades 12, during a demoulding process of the fan blade structure, a pushing force generated by a thimble on the N fan blades 12 can be transferred at least in part to the demoulding ring 13. In other words, the demoulding ring 13 can afford the force of the thimble applied to the N fan blades 12, such that the fan blade structure can be easily demoulded and be protected, and thereby the risk of fan blade structure being damaged is reduced.

If the first radius of the demoulding ring 13 is set to be equal to the second radius of the mounting ring 11, the demoulding ring 13 will be provided on root ends of the N fan blades 12. Thus, the force generated by the thimble and transferred to the demoulding ring 13 during the demoulding process would be very limited, and the N fan blades will not be protected.

If the first radius of the demoulding ring 13 is set to be smaller than the second radius of the mounting ring 11, the demoulding ring 13 cannot be provided on the N fan blades, because the root ends of the N fan blades 12 are disposed on the mounting ring 11.

Further, the demoulding ring 13 and the N fan blades 12 are integrally molded. In other words, the demoulding ring 13 and the N fan blades 12 are mould through a single mould to form an integral structure. Also, during operation of the fan according to the embodiment of the present application, the demoulding ring 13 could be used together. One skilled in the art could use such a design according to practical requirements, which is not limited herein.

Further, in the embodiment of the application, the N fan blades 12 uses a short-length design. In the short-length design, a length of each fan blade is smaller than the first radius, that is, the length of each fan blade is smaller than the first radius of the demoulding ring 13.

As shown in FIG. 2*b*, since a length of each fan blade is smaller than the first radius of the demoulding ring 13, the demoulding ring 13 is disposed on tip ends of the N fan blades 12, and the N fan blades 12 do not extend beyond the demoulding ring 13. For example, if the first radius of the demoulding ring 13 is 4 cm, then a length of each fan blade 120 is 3 cm; or, if the first radius of the demoulding ring 13 is 4 cm, then a length of each fan blade 120 is 2.5 cm; or, if the first radius of the demoulding ring 13 is 3.8 cm, then a length of each fan blade 120 is 3 cm. Further examples are omitted herein. Specific sizes could be chosen by those skilled in the art according to practical requirements, which is not limited herein.

In addition, in the embodiment of the application, each of the N fan blades 12 uses a wing-shaped fan blade design. As shown in FIG. 2*a*, each of the N fan blades 12 forms an angle to a tangent plane of the mounting ring 11, and the angle is 30 degrees, 45 degrees, 60 degrees, or the like, which is not limited herein. The way of disposing the wing-shaped fan blades, the determining of the angle and other parameters are known in the art, which will be omitted herein.

Second Embodiment of the Fan

A fan according to a second embodiment of the application is as follows.

A fan comprises:

a driving structure; and a fan blade structure connected to the driving structure;

wherein the fan blade structure comprises:

a mounting ring connected to the driving structure, the driving structure being able to drive the mounting ring to rotate and in turn being able to drive the fan blade structure to rotate; and N fan blades provided on the mounting ring, N being a positive integer;

wherein both of a first end thickness of a first end of each of the N fan blades and a second end thickness of a second end of each of the N fan blades opposite to the first end are smaller than 0.3 mm; and wherein a maximum thickness of each fan blade is smaller than 0.5 mm and larger than the first end thickness and the second end thickness.

In the technical solution of the present application, the fan blade structure comprises: a mounting ring connected to the driving structure, the driving structure being able to drive the fan blade structure to rotate; and N fan blades provided on the mounting ring, wherein both of a first end thickness of a first end of each of the N fan blades and a second end thickness of a second end of each of the N fan blades opposite to the first end are smaller than 0.3 mm; and wherein a maximum thickness of each fan blade is smaller than 0.5 mm and larger than the first end thickness and the second end thickness. In such a manner, the fan blades according to the embodiment of the application have a thinner thickness than before, so that the weight of the fan can be decreased. Additionally, since the maximum thickness of each fan blade is set to be smaller than 0.5 mm and larger than the first end thickness and the second end thickness, the electronic device can be provided with stronger heat dissipation ability.

Figure 6:
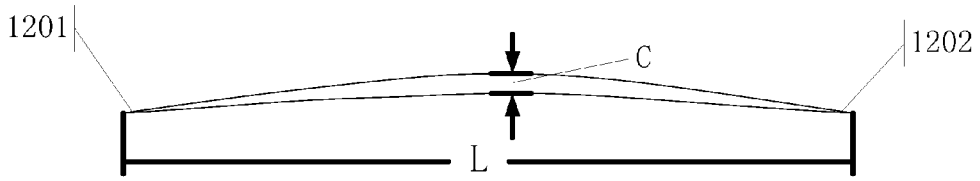
FIG. 6 is a schematic view showing a structure of one blade according to embodiments of the present application.

In order to decrease the weight of the fan, in the embodiment of the application, both the thicknesses of the first end 1201 and the second end 1202 of each fan blade 120 are set to be smaller than 0.3 mm. For example, both the thicknesses of the first end and the second end are equal to 0.28 mm. Or, the thickness of the first end is 0.2 mm while the thickness of the second end is 0.25 mm, and the like. As shown in FIG. 6, the first end 1201 are opposite from the second end 1202.

In the mean time, a maximum thickness of each fan blade is smaller than or equal to 0.5 mm, and the maximum thickness is larger than the first end thickness and the second end thickness. For example, the thickness of the first end is set to 0.3 mm, the thickness of the second end is set to 0.28 mm, and the maximum thickness is set to 0.43 mm. Or, the thicknesses of the first and the second end are set to 0.21 mm, and the maximum thickness is set to 0.32 mm. Further examples are omitted for simplicity. Therefore, each fan blade of the application is much thinner than before, and in the event of having the same number of fan blades, the weight of the fan according the embodiment of the application is much lighter than before.

During implementation of the application, the maximum thickness is formed at an intermediate position of each fan blade 120, or is formed at a position adjacent to the first end 1201 or the second end 1202, which is not specially limited herein.

Figure 7:
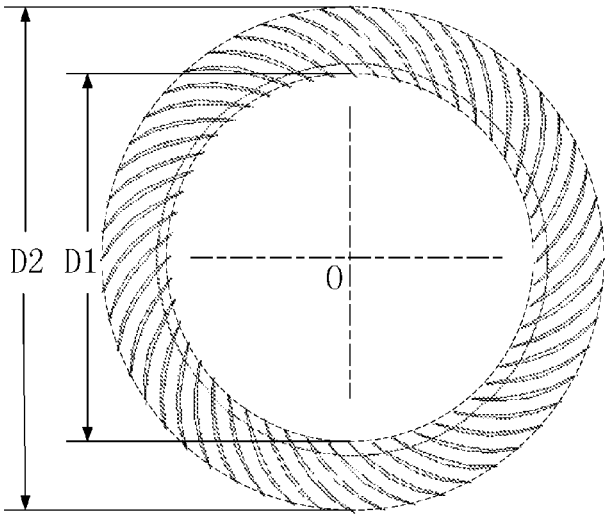
FIG. 7 is a schematic view showing a blade structure according to an embodiment of the present application, in which an inlet diameter D1 and an outlet diameter D2 of the blade structure is shown.
Figure 8A:
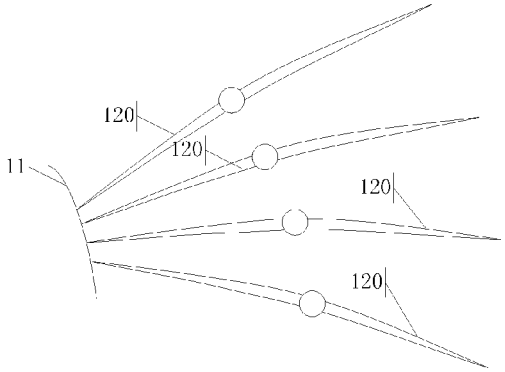
FIGS. 8*a*-8*c* are schematic views showing an arbitrary position of each fan blade according to embodiments of the present application.
Figure 8B:
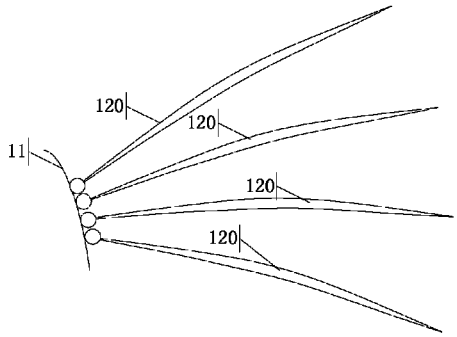
Figure 8C:
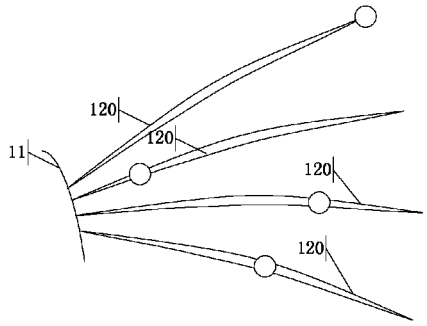

Further, in the embodiment of the application, a first ratio between a diameter D1 of an inlet portion of the fan blade structure 1 and a diameter D2 of an outlet portion of the fan blade structure 1 is smaller than 0.75. Specifically, the N fan blades of the fan blade structure have the same length and are equispaced on the mounting ring 11, as shown in FIG. 7. The first end of each fan blade 120 is connected with the mounting ring 11, or the second end of each fan blade 120 is connected with the mounting ring 11. In the technical field to which the present application pertains, one end of a fan blade connected to the mounting ring is called an intake leading edge or a head portion, and the other end of the fan blade is called an outtake trailing edge or a tail portion. The center O of each fan blade is spaced apart from each head portion at a constant distance, and the center O of each fan blade is spaced apart from each tail portion at a constant distance, such that a small circle is formed in space by the head portions of the N fan blades 12 and a large circle is formed in space by the tail portions of the N fan blades 12, wherein the diameter of the small circle is the inlet diameter D1, and the diameter of the large circle is the outlet diameter D2.

In the embodiment of the application, the ratio of D1/D2 is smaller than 0.75. During specific implementation of the application, the ratio of D1/D2 is set to 0.5, 0.3, 0.72, or the like, which can be determined by one skilled in the art according to practical situations and will not be limited herein.

Furthermore, in the fan according to the embodiment of the application, a second ratio between the maximum thickness C and a distance L from the first end to the second end is smaller than 4%. As shown in FIG. 6, L is the distance between the first end and the second end. If the maximum thickness of each fan blade 120 is located at a position shown in FIG. 6, then the following formula is met: $C/L<4\%$, such as 3.29%, 1.24%, 2.394%, or the like.

Since the N fan blades 12 are thinner, the number of the N fan blades is set to be more than 35 and no more than 70 so as to improve performance of the fan, wherein N is an integer.

When the number of fan blades increases, the fan blade structure 1 promotes performance of air flow, and thereby heat dissipation performance is promoted.

Further Improvements of the Fan

Optionally, in order to further protect the fan blade structure 1 during the demoulding process, in the embodiment of the application, a first thickness, which is larger than the thickness of the N fan blades 12, is provided at an arbitrary position of each fan blade 120, please refer to the circles on the each fan blades 120 shown in FIGS. 3*a*-3*c* and 8*a*-8*c*.

Figure 3A:
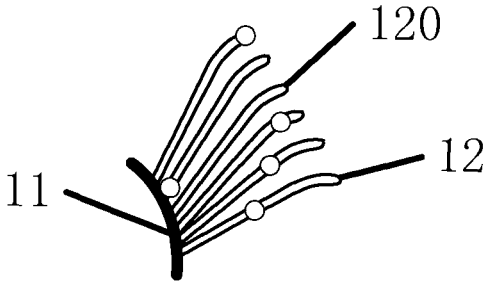
FIGS. 3*a* and 3*c* are schematic views showing an arbitrary position of each fan blade according to embodiments of the present application.
Figure 3B:
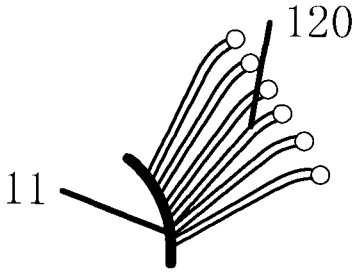
Figure 3C:
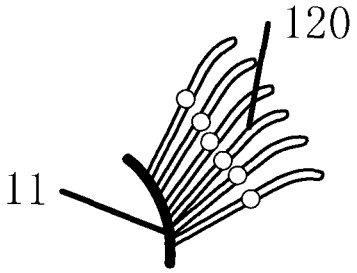

Specifically, the arbitrary position of each fan blade 120 could be any position between the root end and the tip end of each fan blade 120, including the root end and the tip end. The arbitrary positions of the N fan blades could be the same. For example, the arbitrary positioned are provided at the root ends of the blades, as shown in FIG. 3*b*; or the arbitrary positioned are provided at the intermediate positions of the blades, as shown in FIG. 3*c*. Of course, the arbitrary positions could be different in different fan blades. As shown in FIG. 3*a*, the N fan blades comprises 50 fan blades, in which the arbitrary positions of the first, the third, the twenty-second, and thirty-ninth fan blade is located at the tip ends of corresponding fan blades, other arbitrary positions are located at intermediate positions of corresponding fan blades. The positions could be chosen by one skilled in the art according to practical situations, and will be not limited herein.

Furthermore, during a manufacturing process of the fan blade structure, the arbitrary positions are thickened. That is to say, more material will be provided at such arbitrary positions, such that the first thickness of the arbitrary positions of each fan blade 120 is larger than the thickness of the N fan blades 12. For example, if a thickness of each of the N fan blades 12 is 0.20 mm, then the first thickness is 0.40 mm. Or, if a thickness of each of the N fan blades 12 is 0.34 mm, then the first thickness is 0.40 mm. Or, if a thickness of each of the N fan blades 12 is 0.15 mm, then the first thickness is 0.32 mm. These specific values can be determined by one skilled in the art according to practical situations and are not limited herein.

Through thickening each fan blade 120 at an arbitrary position thereof, a resistance of the fan blade structure 1 against external forces during the demoulding process is increased, and the probability of the fan blade structure 1 being damaged is reduced.

Optionally, in order to facilitate the demoulding process, a cross section of each fan blade 120 is configured to have an irregular polygonal shape or an irregular circular shape.

Figure 4:
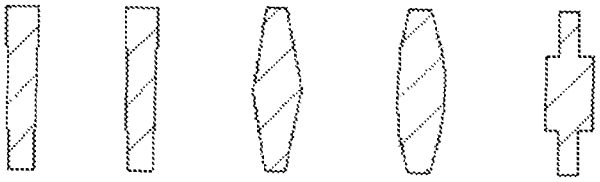
FIG. 4 shows different cross sections a fan blade may have.
Figure 5A:
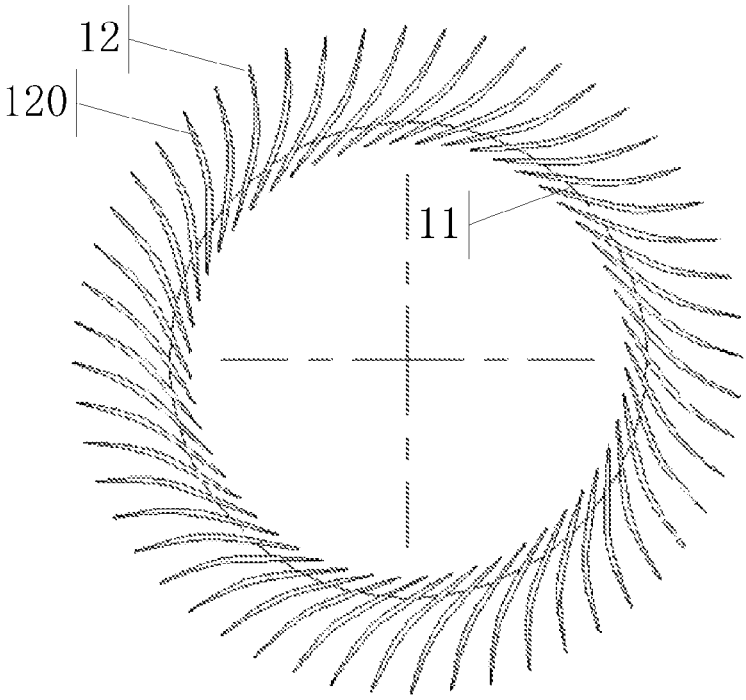
FIGS. 5*a*-5*d* are schematic views showing blade structures according to embodiments of the present application.
Figure 5B:
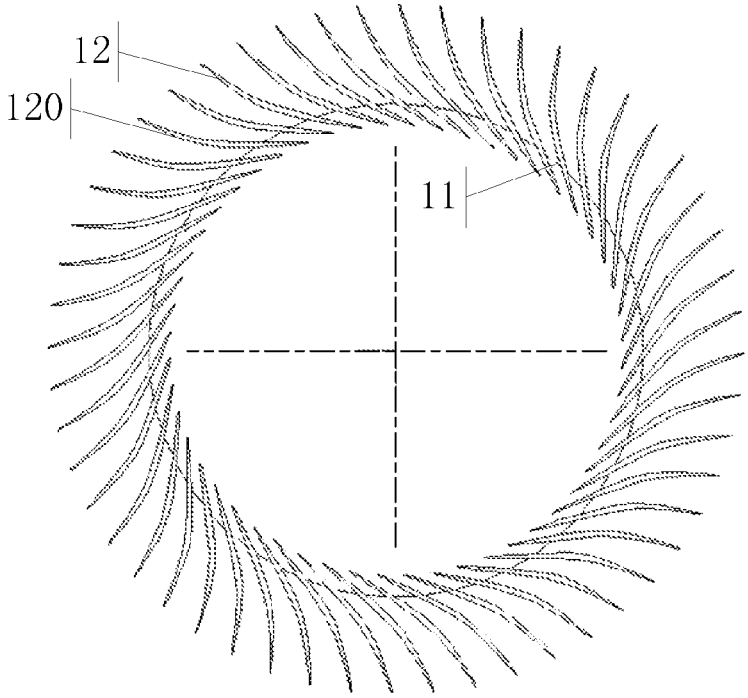
Figure 5C:
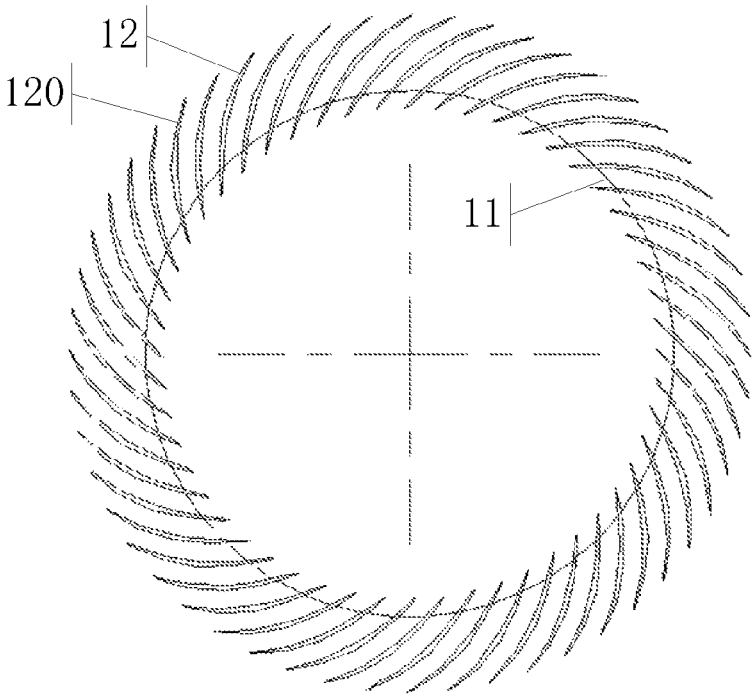
Figure 5D:
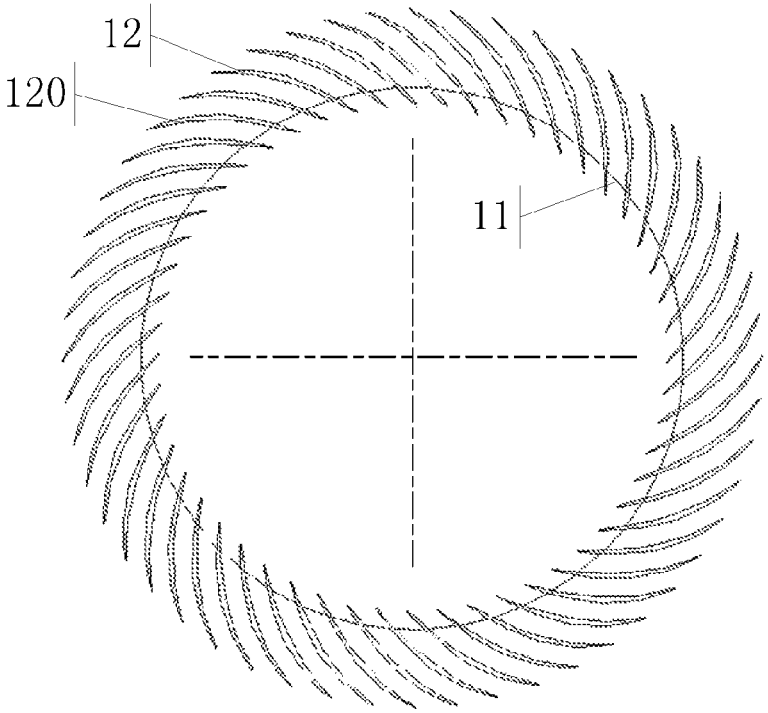

Specifically, since the thickness of the N fan blade is smaller than 0.35 mm, the fan blade structure is easy to be damaged. Therefore, the cross section of each fan blade 120 is configured to have an irregular polygonal shape or an irregular circular shape, such that an irregular-section demoulding process will be adopted during the demoulding process. Suitable shapes for the cross section of the fan blades are shown in FIG. 4 and will be described in detail hereinafter.

Through configuring the cross section of each fan blade 120 to have an irregular polygonal shape or an irregular circular shape, the N fan blades will be protected and the probability of the fan blade structure being damaged is reduced.

Optionally, besides setting the thickness of the N fan blades to be smaller than 0.35 mm, a high strength complex material could be used to manufacture the fan blade structure 1 according to the embodiment of the application. In the embodiment of the application, an exemplary material for manufacturing the fan blade structure 1 comprises a liquid crystal polymer (LCP), a composite of polyphenylene sulfide (PPS) and fibreglasses, and a composite of polyetheretherketone (PEEK) and fibreglasses.

Either of liquid crystal polymers, polyphenylene sulfide and polyetheretherketone has characteristics of low density, high strength, so that the fan blade structure 1 made from a liquid crystal polymer (LCP), a composite of polyphenylene sulfide (PPS) and fibreglasses, or a composite of polyetheretherketone (PEEK) and fibreglasses according to the embodiment of the application will decrease the weight of the fan and in turn decrease a weight of an electronic device.

Optionally, in an embodiment of the application, in order to secure the N fan blades 12 firmly on the mounting ring 11, a third thickness of the root end of each fan blade 120 is different from a fourth thickness of the tip end of each fan blade. Specifically, if a third thickness of the root end of each fan blade 120 is 0.25 mm, then a fourth thickness of the tip end of each fan blade is 0.15 mm; or a third thickness of the root end of each fan blade 120 is 0.15 mm, then a fourth thickness of the tip end of each fan blade is 0.25 mm, as long as the third thickness of the root end of each fan blade 120 is different from the fourth thickness of the tip end of each fan blade. Specific values for the third thickness and the fourth thickness are not specially defined herein.

In practice, it is better when the third thickness of the root end of each fan blade 120 is larger than the fourth thickness of the tip end of each fan blade. In such a way, center of gravity of each fan blade 120 is closer to the root end. Thus, as compared with the situation in which the center of gravity is closer to the tip end, the fan blades will not be detached or separated from the mounting ring 11 easily during rotation or during the demoulding process.

Optionally, surfaces of the N fan blades 12 comprise K residual positions of injection ports.

Specifically, during manufacturing of the fan blade structure, a cavity of a mould is like a closed space. A material for making the fan blade structure 1 according to the embodiments of the application flows into the cavity of the mould through a plurality of injection ports. Therefore, when the moulding process of the fan blade structure 1 is finished, there will be residual positions of injection ports left on the surfaces of the N fan blades 12.

Further, in embodiments of the application, since the number of the fan blades is set to be more than 35 and no more than 70, the number of the fan blades is relatively larger than that of a known fan. Therefore, if the number of the injection ports is relatively small, the material could have been solidified before filling the entire cavity of the mould. Thus, in order to avoid a premature solidification of the material, the number of the residual positions of injection ports on the surfaces of the N fan blades 12 should be larger than 3 and no larger than 15, i.e., the following formula is met: $3<K\leq15$, wherein K is a positive integer.

As above, the number K of the residual positions or the injection ports meet the formula of $3<K\leq15$, such that when manufacturing the fan blade structure, the probability of a premature solidification of the material before filling the entire cavity of the mould is reduced.

Further, in an embodiment of the application, in order to facilitate the demoulding process, the demoulding ring 13 further comprises P residual positions of die thimbles. Specifically, a die thimble is a plastic accessory of a die or a mould for using with the mould. A die thimble is also called a push rod, which is used to separate a product from its mould.

Types of die thimbles comprise flat die thimbles, round die thimbles, holding thimbles, standard thimbles, non-standard thimbles and the like. Materials for die thimbles comprise SKH51, SKD61, SKD11, 65 Mn and the like. A die thimble made from SKH51 is better than a die thimble made from SKD61. The die thimble made of SKD61 can withstand a high temperature up to 1600° C. A nitrogen treatment can increase abrasion resistance of a die thimble made from SKD61. Die thimbles made from 65 Mn have been abandoned for its bad quality and brittleness, which leads to a rupture easily. Those skilled in the art could choose a suitable die thimble according to practical situations, which is not limited herein.

The die thimbles push a finished fan blade structure according to the embodiments of the application out of a mould, and P residual positions of the die thimbles are thereby left on surfaces of the N fan blades.

Further, considering that the thickness of the fan blades is set to be smaller than 0.35 mm, if the number of the die thimbles is relative small, then the pressure on corresponding fan blades is relative large, which will damage the fan blades easily. In order to prevent the N fan blades from being damaged during the demoulding process, at most two fan blades are located between two adjacent die thimbles.

With a configuration that at most two fan blades are located between two adjacent die thimbles, the pressure applied by the die thimbles to corresponding fan blades can be transferred to other fan blades in a large part.

For example, if the number of the fan blades is 50, and there are at most two fan blades located between two adjacent die thimbles, then the number P of the die thimbles is at least 17.

Thus, with such a configuration, in which the demoulding ring comprises P residual positions of die thimbles, P being a positive integer, and at most two fan blades are located between two adjacent die thimbles, an overlarge pressure applied to fan blades by corresponding die thimbles can be transferred to other fan blades, such that the probability of the fan blades being damaged during the demoulding process can be decreased.

Further, it will be an optimal choice if P=N. That is to say, the die thimbles are provided for each of the fan blades 120.

Of course, when forces are applied to the fan blade structure 1 by the die thimbles, pressures at the residual positions of the die thimbles are the largest, such that each fan blade 120 can be easily damaged at corresponding residual position during the demoulding process. In order to decrease the probability of the fan blades being damaged at the residual positions during the demoulding process, a second thickness at the residual positions should be no smaller than 0.2 mm, and should be smaller than or equal to the maximum thickness. In other words, the position of a die thimble corresponds to the position of each fan blade 120 having the maximum thickness, or corresponds to a position of each fan blade having a thickness that is no smaller than 0.2 mm. That is to say, the position of a die thimble should not be set to correspond to a position of each fan blade having a thickness that is smaller than 0.2 mm.

Further, as described above, the number N of the fan blades meet a formula $35<N\leq70$. However, it would be even better if $35<N\leq60$.

In addition, it would be even better if the number K of the residual positions of die thimbles meet a formula $5\leq K\leq10$, wherein K is an integer.

In another aspect, the mould for manufacturing the fan blade structure 1 according to the embodiments of the application is polished at a level that is higher than a B1 level according to SPI standards. Therefore, surfaces of the N fan blades are smooth with no thin fire texture left.

Embodiments of Electronic Device

According to a second aspect of the application, there is provided an electronic device comprising a fan as described above.

According to an embodiment of the application, the electronic device comprises a main body of the device.

Specifically, the main body may be a main body of a desktop computer, a main body of a keyboard for a notebook computer, a main body of a display of an integral computer, or the like. The main body comprises at least one electronic component, and a temperature of the at least one electronic component will exceed a threshold temperature after being operated for a threshold time.

An electronic component should be operated with electricity. However, not all the electricity applied to the electronic component can be used. The unused electricity will be converted to inner energy of the electronic component and energy balance is ensured through heat dissipation. Thus, the threshold time may be 20 minutes, 30 minutes, or the like, the threshold temperature may be 35 Celsius degrees, 45 Celsius degrees, 50 Celsius degrees or the like, which depend on different characteristics of each electronic component, and therefore specific threshold time and threshold temperature are not limited herein.

In order to dissipate the heat generated by the at least one electronic component towards outside of the electronic device, the electronic device also comprises a fan located inside of the main body of the electronic device, wherein the fan is a fan according to any one of the embodiments of the application as described above.

An operational principle of the fan is introduced hereinabove, which will not be repeated herein.

According to an embodiment of the electronic device, the electronic device comprises a fan according the first embodiment of the fan.

In the embodiment, the fan blade structure of the fan comprises: a mounting ring connected to the driving structure, the driving structure being able to drive the mounting ring to rotate; and N fan blades provided on the mounting ring, a thickness of each fan blade is smaller than 0.35 mm, N being an integer and $35<N\leq70$. In such a manner, the fan blades according to the embodiment of the application have a thinner thickness than before, so that the weight of the fan can be decreased, and the number of the fan blades is much larger, and stronger heat dissipation ability can be provided for the electronic device.

Optionally, a demoulding ring is provided on the N fan blades, and a first radius of the demoulding ring is larger than a second radius of the mounting ring; or, a first thickness at an arbitrary position of each fan blade is larger than a thickness of the N fan blades; or, a cross section of each fan blade is set to an irregular polygonal shape or an irregular circular shape; or, a length of each fan blade is set be smaller than the first radius; or, a third thickness of a root end of each fan blade is different from a fourth thickness of a tip end of the fan blade. With the above configurations, the N fan blades can be protected during a demoulding process of the fan blade structure, and thereby the probability of the fan blade structure being damaged is decreased.

According to another embodiment of the electronic device, the electronic device comprises a fan according the second embodiment of the fan.

In the technical solution of the present application, the fan blade structure comprises: a mounting ring connected to the driving structure, the driving structure being able to drive the fan blade structure to rotate; and N fan blades provided on the mounting ring, wherein both of a first end thickness of a first end of each of the N fan blades and a second end thickness of a second end of each of the N fan blades opposite to the first end are smaller than 0.3 mm; and wherein a maximum thickness of each fan blade is smaller than 0.5 mm and larger than the first end thickness and the second end thickness. In such a manner, the fan blades according to the embodiment of the application have a thinner thickness than before, so that the weight of the fan can be decreased, and the number of the fan blades is much larger, and stronger heat dissipation ability can be provided for the electronic device. Optionally, a first ratio between a diameter of an inlet portion of the fan blade structure and a diameter of an outlet portion of the fan blade structure is smaller than 0.75; or, a second ratio between a maximum thickness of each fan blade and a distance from a first end to a second end of the fan blade is smaller than 4%. With such configurations, a weight of the fan can be further decreased, and heat dissipation ability of the fan is promoted.

Optionally, the number N the fan blades is set to meet a formula $35<N\leq70$, such that an even stronger heat dissipation ability can be provided for the electronic device.

Optionally, a thickness at an arbitrary position of each fan blade is set to be larger than the first end thickness and the second end thickness, or the first end thickness is set to be different from the second end thickness, such that the fan blades will be protected during the demoulding process, so that the probability of the fan blade structure being damaged is decreased.

In further embodiments of the electronic device of the application, optionally, a liquid crystal polymer, or a composite of polyphenylene sulfide (PPS) and fibreglasses is used as the material for forming the fan blade structure, which will further decrease the weight of the fan.

Optionally, since the number of the fan blades is relative large, the number K of the residual positions of injection ports on the surfaces of the N fan blades is set to meet a formula of $3<K\leq15$, wherein K is a positive integer, such that the probability of a premature solidification of the material before filling the entire cavity of the mould is decreased.

Optionally, the demoulding ring comprises P residual positions of die thimbles, wherein P is a positive integer, and there are at most two fan blades located between two adjacent residual positions of die thimbles. With such a configuration, an overlarge force applied by the die thimbles to corresponding fan blades can be transferred to other fan blades, and a probability of the fan blades being damaged during the demoulding process can be decreased.

Cross Section Design for a Fan Blade

A third aspect of the application relates to designs for a cross section of a fan blade.

Figure 9:
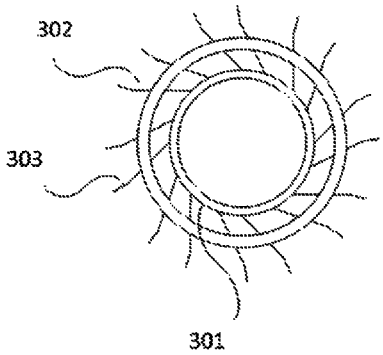
FIG. 9 is an illustrative schematic view showing a centrifugal fan according to an embodiment of the present application.
Figure 10:
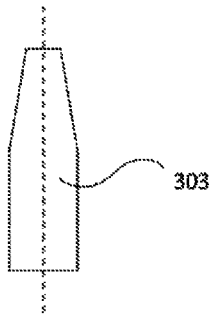
FIG. 10 is an illustrative schematic view showing a cross section of a blade of a centrifugal fan according to an embodiment of the present application.

As shown in FIGS. 9 and 10, a centrifugal fan is provided according to an embodiment of the application, the centrifugal fan comprises: a motor (not shown in the figures), a mounting ring 301, and a fan blade structure 302.

The mounting ring 301 is mounted on the motor; the fan blade structure 302 comprises a plurality of fan blades 303 mounted on the mounting ring 301; the motor drives mounting ring 301 and in turn the fan blade structure 302 to rotate, and a centrifugal force generated by the fan blade structure 302 causes a flow of air, wherein air flows into spaces between the plurality of fan blades 303 along an axial direction of the fan blade structure 302, and flows out of the spaces between the plurality of fan blades 303 along a radial direction of the fan blade structure 302.

A cross section of each fan blade 303 in parallel with the axial direction (or, a cross section of each fan blade in perpendicular to its extension direction) has a non-uniform width. For example, a cross section is obtained in a plane perpendicular to a straight line extending from the rotation center of the fan along the fan blade 303. A width of the cross section actually indicates a thickness of the fan blade 303.

In the technical solution according to an embodiment of the application, widths at different positions of the cross section of the fan blade 303 of the fan blade structure 302 are different, which means a part of the cross section of the fan blade 303 is made thinner as compared with those in related arts, and which leads to a thinner part and a thicker part of the fan blade 303. The thicker part of the fan blade 303 ensures that the fan blade structure 302 has good strength and productivity, while the thinner part can decrease the weight of the fan blade structure 302. In the mean time, a thinner fan blade 303 will help to increase the number of the fan blades 303 and thereby improve performance of the centrifugal fan and increase a flow of the air and a pressure of the air.

Figure 11:
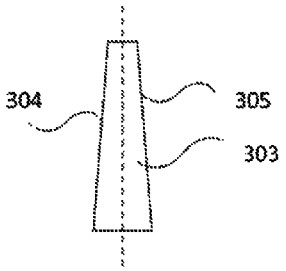
FIG. 11 is an illustrative schematic view showing a cross section of a blade of a centrifugal fan according to another embodiment of the present application.

Preferably, as compared to the centrifugal fan according to the above embodiment, in a centrifugal fan according to another embodiment of the application, a cross section of a fan blade has a first straight line side 304 and a second straight line side 305 extending in a length direction of the cross section, the first straight line side 304 and the second straight line side 305 are not in parallel with each other, and an angle is formed between the straight lines along which the first straight line side 304 and the second straight line side 305 extend respectively, as shown in FIG. 11.

In this embodiment of the application, the first straight line side 304 and the second straight line side 305 are not in parallel with each other and a distance between them changes, which result in a cross section gradually tapered from one end to the other end thereof This cross section shape for fan blades 303 according to this embodiment is suitable for manufacturing.

Figure 12:
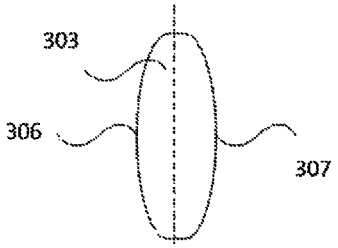
FIG. 12 is an illustrative schematic view showing a cross section of a blade of a centrifugal fan according to a further embodiment of the present application.

Preferably, as compared to the centrifugal fan according to the above embodiments, in a centrifugal fan according to another embodiment of the application, a cross section of a fan blade has a first camber line side 306 and a second camber line side 307 extending in a length direction of the cross section, each of the first camber line side 306 and the second camber line side 307 forms a protrusion in the cross section, as shown in FIG. 12.

In this embodiment of the application, a distance between the first camber line side 306 and the second camber line side 307 changes gradually, which result in a cross section having a wider intermediate portion and two narrower ends, so that the thickness of the fan blade 303 gradually decrease from intermediate portion to two ends thereof This cross section shape for fan blades 303 according to this embodiment is suitable for manufacturing.

Figure 13:
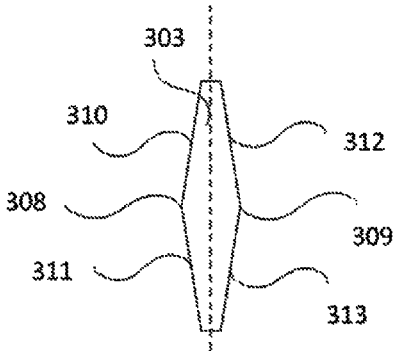
FIG. 13 is an illustrative schematic view showing a cross section of a blade of a centrifugal fan according to a still further embodiment of the present application.

Preferably, as compared to the centrifugal fan according to the above embodiments, as shown in FIG. 13, in a centrifugal fan according to another embodiment of the application, a cross section of a fan blade has a first broken line side 308 and a second broken line side 309 extending in a length direction of the cross section. The first broken line side 308 comprises a first sub straight line side 310 and a second sub straight line side 311 with a first included angle formed between the first sub straight line side 310 and the second sub straight line side 311. The second straight line side 309 comprises a third sub straight line side 312 and a fourth sub straight line side 313 with a second included angle formed between the third sub straight line side 312 and the fourth sub straight line side 313. Each of the first angle and the second angle forms a protrusion in the cross section.

In this embodiment of the application, a distance between the first broken line side 308 and the second broken line side 309 changes gradually, which result in a cross section having a wider intermediate portion and two narrower ends, so that the thickness of the fan blade 303 gradually decrease from intermediate portion to two ends thereof This cross section shape for fan blades 303 according to this embodiment is suitable for manufacturing.

Figure 14:
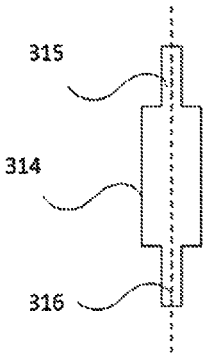
FIG. 14 is an illustrative schematic view showing a cross section of a blade of a centrifugal fan according to a still further embodiment of the present application.

Preferably, as compared to the centrifugal fan according to the above embodiments, in a centrifugal fan according to another embodiment of the application, a cross section of a fan blade is divided into a first rectangle 314, a second rectangle 315 and a third rectangle 316 connected with the first rectangle 314 respectively, as shown in FIG. 14. The second rectangle 315 and the third rectangle 316 are connected to two opposite sides of the first rectangle 314 respectively, and the width of the first rectangle 314 is larger than the width of the second rectangle 315 and the width of the third rectangle 316.

In this embodiment of the application, since the width of the first rectangle 314 is larger than the width of the second rectangle 315 and the width of the third rectangle 316, the cross section having a wider intermediate portion and two narrower ends. This cross section shape for fan blades 303 according to this embodiment is suitable for manufacturing.

Preferably, as compared to the centrifugal fan according to the above embodiments, in a centrifugal fan according to another embodiment of the application, the plurality of fan blades 303 are all made from a plastic.

In this embodiment of the application, the plastic chosen should be easy to manufacture and should be able to meet requirements for the shape of the cross section of the fan blade, and the shape for fan blades 303 according to this embodiment is suitable for manufacturing.

The centrifugal fan according to the above embodiments of the application has at least the following advantages.

A shape of a cross section of a fan blade is not a regular rectangle, but a shape having different widths, which means a part of the cross section of the fan blade is made thinner as compared with those in related arts, and which leads to a thinner part and a thicker part of the fan blade. The thicker part of the fan blade ensures that the fan blade structure has good strength and productivity, while the thinner part can decrease the weight of the fan blade structure. In the mean time, a thinner fan blade will help to increase the number of the fan blades and thereby improve performance of the centrifugal fan and increase a flow of the air and a pressure of the air.

Although several exemplary embodiments have been shown and described, it would be appreciated by those skilled in the art that various changes or modifications can be made in these embodiments without departing from the principles and spirit of the disclosure, the scope of which is defined in the claims and their equivalents.

What is claimed is:

1. A fan, comprising:

a fan blade structure comprising:

a mounting ring and a plurality of fan blades provided on the mounting ring, wherein the mounting ring and the fan blades are integrally formed; and wherein the plurality of the fan blades comprise a plurality of residual positions of die thimbles, and the number of the residual positions of the die thimbles are no larger than the number of the fan blades.

2. The fan according to claim 1, wherein the fan blade structure further comprises a demoulding ring provided on the plurality of fan blades, and the radius of the demoulding ring is larger than the radius of the mounting ring.

3. The fan according to claim 2, wherein a length of each fan blade is shorter than the radius of the demoulding ring.

4. The fan according to claim 2, wherein the demoulding ring is integrally formed with the plurality of fan blades.

5. The fan according to claim 1, wherein the fan blade structure is made from a liquid crystal polymer, a composite of polyphenylene sulfide and fibreglass, or a composite of polyetheretherketone and fibreglass.

6. The fan according to claim 1, wherein a plurality of residual positions of injection ports are located on surfaces of the plurality of the fan blades, and the number of the residual positions of injection ports is larger than 3 and no larger than 15.

7. The fan according to claim 1, wherein at most two fan blades are located between two adjacent residual positions of die thimbles.

8. The fan according to claim 1, wherein the thickness of each fan blade is smaller than 0.35 mm.

9. The fan according to claim 1, wherein the number of the fan blades is more than 35 but no more than 70.

10. The fan according to claim 1, wherein the thickness of opposite ends of each fan blade is smaller than 0.3 mm.

11. A mould configured for making a fan blade structure comprising a mounting ring and a plurality of fan blades provided on the mounting ring, the mould comprising a cavity to integrally form the fan blade structure, wherein the cavity comprises:

a ring-shaped channel configured for forming the mounting ring; and a plurality of fan blade channels configured for forming the plurality of fan blade, wherein the plurality of the fan blades comprise a plurality of residual positions of die thimbles, and the number of the residual positions of the die thimbles are no larger than the number of the fan blades.

12. The mould of claim 11, wherein the number of fan blade channels is more than 35 but no more than 70.

13. The mould according to claim 11, further comprising a plurality of injection passages extending from an outer surface of the mould to the cavity, wherein the number of injection passages is set to be larger than 3 and no larger than 15.

14. The mould according to claim 11, further comprising a plurality of thimble passages, wherein the number of thimble passages is set to be no larger than the number of the fan blades.

15. The mould according to claim 14, wherein the thimble passages are configured to have at most two fan blades located between two adjacent thimble passages.

16. The mould according to claim 14, wherein the number of thimble passages is set to be equal to the number of the fan blades, and each thimble passage corresponds to one corresponding fan blade.

17. The mould according to claim 11, wherein a width of each fan blade passage corresponding to a thickness of a fan blade is configured to be smaller than 0.35 mm.

18. The mould according to claim 11, wherein each fan blade passage is configured to have a width decreasing gradually from an intermediate portion to both end portions of the fan blade passage, and a width of the end portions is smaller than 0.3 mm, and a maximum width of the intermediate portion is no larger than 0.5 mm.

* * * * *